US006878174B1

(12) United States Patent
Conochie

(10) Patent No.: US 6,878,174 B1
(45) Date of Patent: Apr. 12, 2005

(54) STABILIZING THERMALLY BENEFICIATED CARBONACEOUS MATERIAL

(75) Inventor: David Stewart Conochie, Camberwell (AU)

(73) Assignee: K-Fuel L.L.C., Denver, CO (US)

( * ) Notice: Subject to any disclaimer, the term of this patent is extended or adjusted under 35 U.S.C. 154(b) by 0 days.

(21) Appl. No.: 09/446,447

(22) PCT Filed: Jun. 23, 1998

(86) PCT No.: PCT/AU98/00484

§ 371 (c)(1),
(2), (4) Date: Apr. 13, 2000

(87) PCT Pub. No.: WO98/59209

PCT Pub. Date: Dec. 30, 1998

(30) Foreign Application Priority Data

Jun. 23, 1997 (AU) ..... PO7482

(51) Int. Cl.[7] ..... C10L 5/00
(52) U.S. Cl. ..... 44/620; 44/626
(58) Field of Search ..... 44/620, 626

(56) References Cited

U.S. PATENT DOCUMENTS 4,213,752 A 7/1980 Seitzer
4,493,157 A 1/1985 Wicker
5,746,787 A 5/1998 Koppelman
5,863,304 A 1/1999 Viall et al.
6,090,171 A * 7/2000 Viall et al. ..... 44/501

FOREIGN PATENT DOCUMENTS

WO WO 91/17391 11/1991

OTHER PUBLICATIONS

Australian Patent Abstract, document No. AU–A–41497/93 entitled: Fluidized Bed Reactor for Cooling or Heating Granular Solids by an Indirect Heat Exchange; 12 pages, 1993.

* cited by examiner

*Primary Examiner*—Cephia D. Toomer
(74) *Attorney, Agent, or Firm*—Harness, Dickey & Pierce, P.L.C.

(57) ABSTRACT

A method of stabilizing a thermally beneficiated carbonaceous material is disclosed. The method includes the steps of supplying a charge of the carbonaceous material at an elevated temperature to a process vessel to form a packed bed and cooling the carbonaceous material to a target temperature by indirect heat exchange. The method is characterised by supplying an oxygen-containing gas to the packed bed to partially oxidise the carbonaceous material to a required degree to stabilize the carbonaceous material prior to the carbonaceous material reaching the target temperature. The method is also characterised by removing heat from the packed bed that is produced by oxidation of carbonaceous material to control the temperature of the carbonaceous material during oxidation to avoid thermal runaway.

19 Claims, 2 Drawing Sheets

STABILIZING THERMALLY BENEFICIATED CARBONACEOUS MATERIAL

The present invention relates to stabilizing thermally beneficiated carbonaceous material, such as coal.

The present invention relates particularly, although by no means exclusively, to stabilizing coals, such as low rank coals, that have been thermally beneficiated under conditions including high temperature and pressure to increase the BTU value of the coal by removing water from the coal.

It is known that many coals are susceptible to spontaneous combustion when stored in a stockpile. The spontaneous combustion is caused by:

(i) oxidation of coal producing hot spots which drive thermal convection of air in the coal bed; and (ii) the thermal convection of air in turn providing more oxygen for oxidation.

Compaction of stockpiles to reduce bed permeability and containment of stockpiles to minimise access to oxygen are two means of starving coals of oxygen and thereby preventing spontaneous combustion. However, compaction and containment are not practical or complete solutions in many instances.

It is also known that thermally beneficiated coals are susceptible to spontaneous combustion. In particular, the potential for spontaneous combustion is a significant issue in relation to cooling hot dewatered coals produced in thermal beneficiation processes prior to stockpiling the coal.

There are a number of known proposals for stabilizing thermally beneficiated coal, such as the proposal of Western Syncoal Company described in Australian patent application 56103/96 and the proposals in the prior art patents referred to on pages 5 to 8 of the Syncoal Australian patent application.

An object of the present invention is to provide an improved method and apparatus for stabilizing thermally beneficiated coal compared to the prior art referred to in the preceding paragraph.

According to the present invention there is provided a method of stabilizing a thermally beneficiated carbonaceous material which comprises:

(a) supplying a charge of the carbonaceous material at an elevated temperature, as described herein, to a process vessel to form a packed bed;

(b) cooling the carbonaceous material in the packed bed from the elevated temperature to a target temperature by indirect heat exchange;

(c) before the carbonaceous material reaches the target temperature, supplying an oxygen-containing gas to the packed bed to partially oxidise the carbonaceous material to a required degree to stabilize the carbonaceous material; and (d) removing heat from the packed bed that is produced by oxidation of carbonaceous material to control the temperature of the carbonaceous material during oxidation to avoid thermal runaway.

The term "thermal runaway" is understood in general terms to be a rapid uncontrolled increase in temperature, caused by oxidation of carbonaceous material generating heat and the heat increasing the rate of oxidation of carbonaceous material, which can lead to a loss of process control.

The applicant has found in experimental work on rate of oxidation and with computational fluid dynamics modelling of stockpiles based on the experimental data that for a thermally beneficiated coal of a given size distribution:

(i) the extent of oxidation of the coal;

(ii) the stockpile temperature of the coal; are 2 variables which have the most significant impact on spontaneous combustion of the coal in a stockpile that has not been subjected to compaction or containment.

Figure 1:
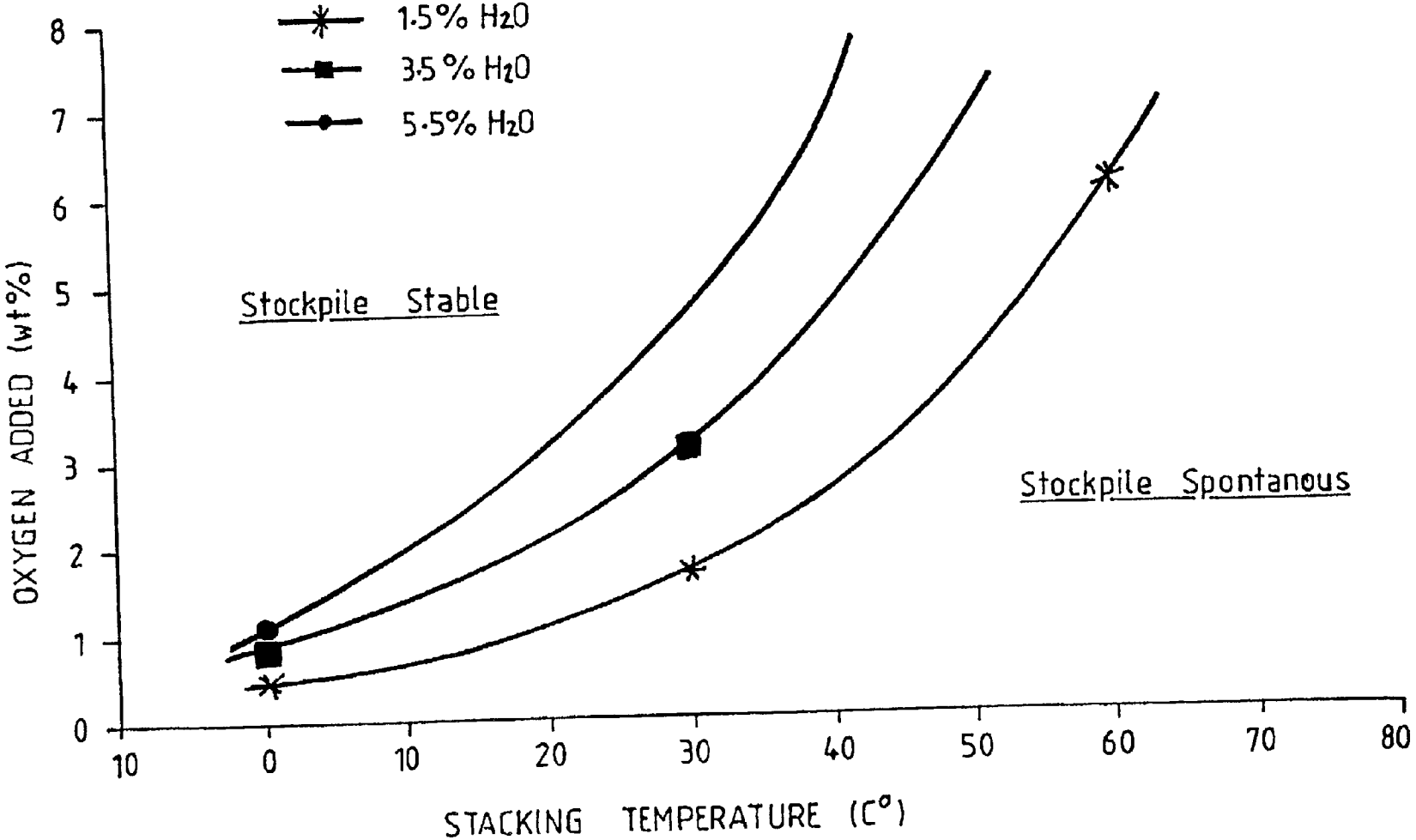
FIG. 1 One example of an experimentally derived graph of temperature and oxidation that indicates stable condition for stockpiling thermally beneficiated coal.

By way of explanation, FIG. 1 of the accompanying drawings is one example of an experimentally derived graph of temperature and oxidation (expressed in terms of wt % oxygen added) produced by the applicant which indicates stable conditions for stockpiling thermally beneficiated coal.

As can be seen from the regime diagram of FIG. 1, oxidation alone is not sufficient to provide stockpile stability unless a very high level of oxidation is used. The high level of oxidation that is required if no cooling is used is not a practical option because it would make the product commercially unattractive.

FIG. 1 indicates that, from the viewpoint of producing a commercially attractive product that can be stockpiled safely, it is necessary to cool thermally beneficiated coal to a relatively low stockpile temperature, ie target temperature.

In the context of the method of the present invention, in situations where the carbonaceous material is coal, it is preferred that the amount of oxidation, measured as the weight of oxygen supplied to the packed bed as a percentage of the total weight of the coal in the packed bed, be in the range of 0.2 to 5 wt % and that the target temperature be less than 50° C.

It is preferred particularly that the amount of oxidation be in the range of 0.5 to 3 wt % and that the target temperature be less than 35° C.

The applicant has also found in experimental/design/modelling work that a combination of a working fluid circulating through the packed bed and a coolant circuit which includes heat transfer surfaces in the packed bed is an effective means of removing heat from the packed bed that is produced by oxidation of carbonaceous material.

The removal of such heat is an important consideration in order to control the temperature of the carbonaceous material to avoid thermal runaway. The mechanism of heat removal is via heat transfer from the carbonaceous material to the working fluid and then via heat transfer from the working fluid to the internal heat transfer surfaces.

The applicant has found in experimental/design/modelling work that particularly suitable internal heat transfer surfaces are the heat exchange plates disclosed in International applications PCT/AU98/00005, PCT/AU98/00142, and PCT/AU98/00324 of the applicant and the entire disclosure in these International applications is incorporated herein by cross-reference.

The above described combination of circulating working fluid and the coolant circuit with internal heat transfer surfaces is an important feature because it enables a substantial increase in the size of the packed bed whilst maintaining high productivity when compared with known prior art proposals, such as that disclosed in the Syncoal Australian patent application, and thereby reduces significantly the capital and operating costs.

It is preferred that the working fluid be a gas.

Gases that may be used as the working gas include nitrogen, steam, $SO_2$, $CO_2$ hydrocarbons, noble gases, refrigerants, and mixtures thereof.

It is preferred that the working fluid be unreactive with the packed bed.

It is preferred that the method comprises cooling the carbonaceous material from the elevated temperature to a preferred oxidation temperature of the carbonaceous material without supplying oxygen-containing gas to the packed bed during this initial cooling step and, when the preferred oxidation temperature is reached, supplying the oxygen-containing gas to the packed bed to partially oxidise the carbonaceous material.

The temperature described by the term "preferred oxidation temperature of the carbonaceous material" is understood herein to mean the mass weighted average temperature of the particles in the packed bed.

It is preferred that the preferred oxidation temperature of the carbonaceous material be the temperature at which the carbonaceous material can be oxidised quickly with a given partial pressure of oxygen in the oxygen-containing gas to yield a stable product, but with heat transfer conditions such that the heat released does not cause thermal runaway.

In situations where the combination of circulating working fluid and the coolant circuit with internal heat transfer surfaces is used as the means for removing heat from the packed bed generated by oxidation of carbonaceous material it is preferred that the method comprises controlling the temperature of the heat transfer surfaces relative to the preferred oxidation temperature to maintain a small gradient across the bed while maintaining high rates of heat transfer. Preferably the temperature difference is less than 40° C., more preferably less than 30° C.

In situations where the combination of circulating working fluid and the coolant circuit with internal heat transfer surfaces is used as the means for removing heat from the packed bed generated by oxidation of carbonaceous material, it is preferred that the method comprises controlling the temperature of the working fluid to be greater than the wall temperature of the internal heat transfer surfaces and less than that of the particles of carbonaceous material so that cooling of the particles is maintained. It is also noted that cooling is improved with operation of pressure.

In a situation where the carbonaceous material is thermally beneficiated coal it is preferred that the preferred oxidation temperature be in the range of 80–150° C.

It is preferred particularly that the preferred oxidation temperature be in the range of 100–150° C.

It is preferred more particularly that the preferred oxidation temperature be in the range of 100–120° C.

It is preferred particularly that the method comprises maintaining the temperature of the carbonaceous material at the preferred oxidation temperature or within a temperature range which includes the preferred oxidation temperature during the step of supplying the oxygen-containing gas to the packed bed.

It is preferred that, after the oxidation step is completed, the method comprises cooling the carbonaceous material to the target temperature.

It is preferred that the target temperature be less than 50° C.

It is preferred that the method further comprises pressurising the packed bed prior to or during cooling and oxidation of the carbonaceous material.

It is preferred particularly that the method comprises pressurising the packed bed with an externally supplied gas to a pressure of less than 20 bar and typically less than 10 bar.

It is preferred that the particle size of the carbonaceous material be selected so that the packed bed formed has sufficient permeability to allow movement of working fluid with reasonable pressure drop.

According to the present invention there is provided an apparatus for stabilizing a thermally beneficiated carbonaceous material in accordance with the method of the present invention as described above.

Figure 2:
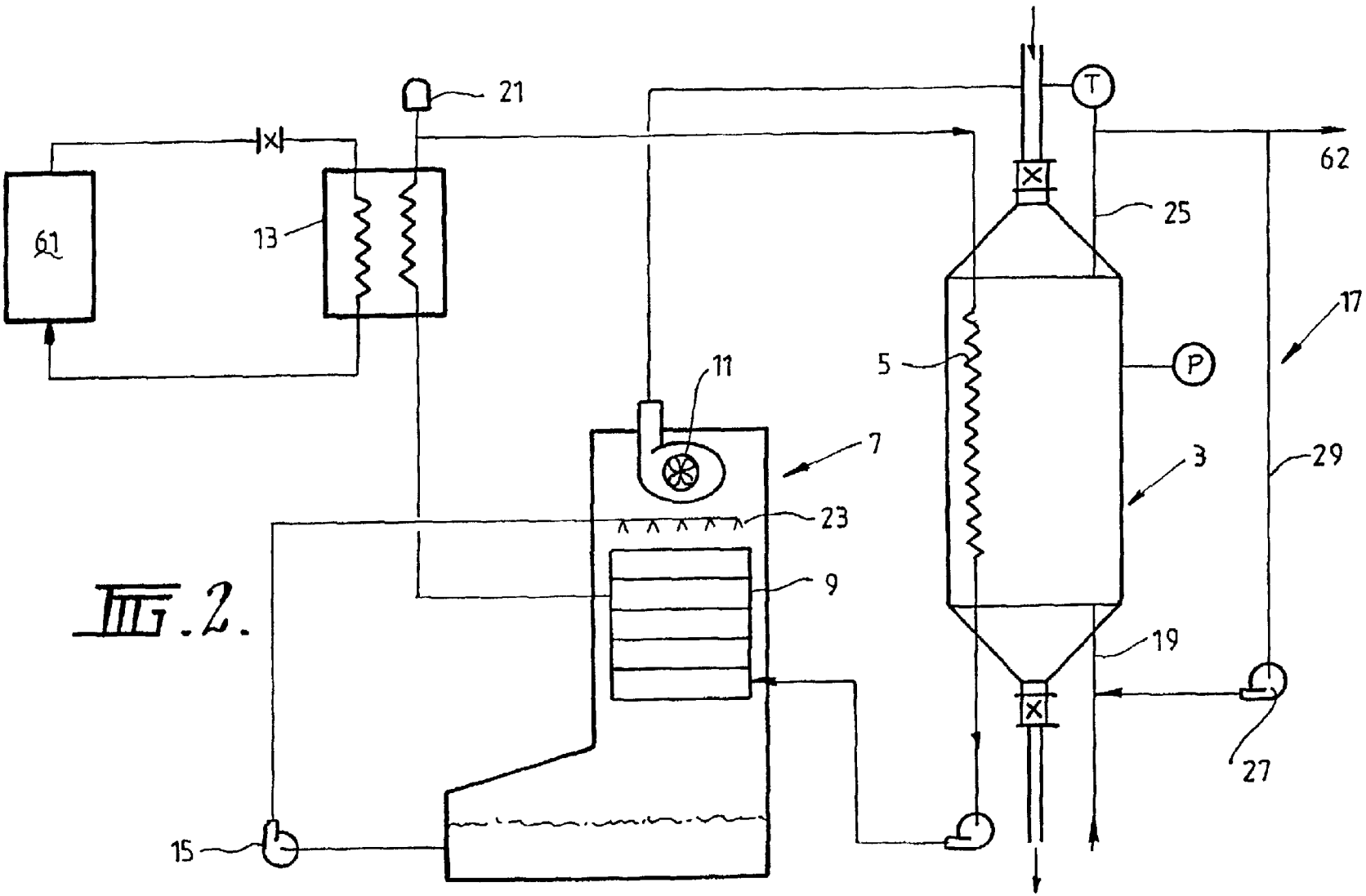
FIG. 2 A schematic diagram that illustrates a preferred embodiment of the present method and the apparatus for practicing the present method.

The present invention is described further by way of example with reference to FIG. 2 which is a schematic diagram which illustrates a preferred embodiment of the method and the apparatus of the present invention.

The following description is in the context of stabilizing thermally beneficiated coal. It is noted that the present invention is not limited to this application and extends to stabilizing any suitable thermally beneficiated carbonaceous material.

With reference to FIG. 2, the apparatus comprises a pressure vessel 3 which is adapted to stabilize a packed bed of thermally beneficiated coal that has been discharged and supplied to the pressure vessel 3 at an elevated temperature, typically 400° C., from a thermal beneficiation process vessel (not shown).

The pressure vessel 3 may be of any suitable configuration which includes an internal assembly of heat exchange plates 5. One example of a suitable pressure vessel is the pressure vessel disclosed in International applications PCT/AU98/00005, PCT/AU98/00142 and PCT/AU98/00324 of the applicant which includes an inverted conical inlet, a cylindrical body, a conical outlet, and an assembly of vertically disposed parallel heat transfer plates positioned in the body and the conical outlet.

The heat exchange plates 5 form part of a coolant circuit which circulates a small volume of a coolant suitable for −20° C. to 140° C. operation through the plates 5 in a closed circuit.

The coolant circuit also includes a cooling tower 7 which comprises an exchanger tube bank 9 positioned in the tower, a variable speed fan 11 that induces an updraft flow of air past the exchanger tube bank 9, and an evaporative system which includes nozzles 23 positioned to spray water onto the exchanger tube bank 9 and a pump 15 which pumps water from a reservoir in the base of the tower to the nozzles 23. It is noted that in cold climates the evaporative system may not be required.

The coolant circuit also includes a chiller 61 for further cooling coolant from the cooling tower 9 by heat exchange in a heat exchanger 13.

The coolant circuit also includes an expansion chamber 21 to accommodate pressure variations in the coolant circuit.

The apparatus further comprises a system, generally identified by the numeral 17, for supplying and thereafter circulating a working fluid, typically a gas such as nitrogen, through the packed bed in the process vessel 3 for pressurising and enhancing heat exchange between the coolant flowing through the plates 5 and the coal in the packed bed. The working fluid system 17 includes an inlet 19 for working fluid in the base of the process vessel 3, an outlet 25 in the top wall of the process vessel 3, a line 29 which connects the inlet/outlet 19/25 and fan 27 which circulates the working fluid through the packed bed and the line 29. The working fluid system 17 is described in more detail in International application PCT/AU98/00142 of the applicant.

The apparatus further comprises a means for supplying an oxygen-containing gas to the packed bed 3 to oxidise the thermally beneficiated coal. In the embodiment shown in FIG. 2, the oxygen-containing gas is supplied to the working fluid inlet 19.

In use of the apparatus shown in FIG. 2, a hot charge of thermally beneficiated coal (typically at a temperature above 300° C.) is supplied to the process vessel 3 to form a packed bed, the solids inlet outlet valve (not shown) is then closed, the working fluid is supplied via inlet 19 to fill the packed bed, and the working fluid fan 27 is turned on to circulate the working fluid through the packed bed.

In the preferred embodiment of the method, the coolant circuit pump runs continuously—although at this initial stage of operation the cooling tower fan 11 and the water pump 15 are switched off.

Under these conditions, the pressure and the temperature of the coolant rises, with expansion and pressure in the coolant circuit being controlled by the expansion chamber 21.

When the coolant temperature reaches 120° C., which indicates a mass weighted average temperature of coal in the packed bed of the order of 140° C., the cooling tower air fan 11 is switched on and the speed is varied to maintain the coolant temperature at 120° C.

Thereafter, the oxygen-containing gas is supplied to the packed bed and the system is held at a constant temperature until sufficient oxygen has been added to the packed bed to complete a required level oxidation of coal.

As indicated above, during this oxidation stage, it is important to remove heat produced by oxidation of coal from the packed bed in order to avoid thermal runaway, and the applicant has found that the combination of the heat exchange plates 5 operating with coolant circulating through the plates in a closed circuit and circulating working fluid in the packed bed is an effective means of providing the necessary temperature control in the packed bed to achieve this objective.

The applicant has also found that it is important that the wall temperature of the heat exchange plates 5 be kept close to that of the packed bed in order to maintain a small temperature gradient across the bed. The small temperature gradient is desirable in order to reduce local variations in cooling and therefore oxidation in the packed bed.

At the completion of the addition of the oxygen-containing gas, the cooling tower fan is switched to full speed, the water pump 15 is switched on, and the temperature of the packed bed, including the coal, is driven to the target temperature, typically less than 50° C.

If required, the chiller circuit 61 is switched on to lower the coolant temperature to give a cooler product in a shorter time.

When the packed bed reaches the target temperature, the packed bed is vented through vent 62 and the cooled, stabilized, thermally beneficiated coal is discharged from the process vessel 3 and is stock piled.

Many modifications may be made to the preferred embodiment of the method and apparatus of the present invention that is described above in relation to FIG. 2 without departing from the spirit and scope of the present invention.

By way of example, whilst the preferred embodiment comprises supplying the oxygen-containing gas into the packed bed via the working fluid inlet 19 in the base of the process vessel 3, it can readily be appreciated that the present invention is not restricted to this arrangement, and it is within the scope of the present invention to introduce the oxygen-containing gas into the packed bed at any suitable location(s).

What is claimed is:

1. A method of stabilizing a thermally beneficiated carbonaceous material which comprises:

(a) supplying a charge of the carbonaceous material at an elevated temperature resulting from thermal beneficiation to a process vessel to form a packed bed;

(b) cooling the carbonaceous material in the packed bed from the elevated temperature to a target temperature less than the elevated temperature by indirect heat exchange;

(c) before the carbonaceous material reaches the target temperature, supplying an oxygen-containing gas to the packed bed to partially oxidise the carbonaceous material to a required degree to stabilize the carbonaceous material; and (d) removing heat from the packed bed during partial oxidation that is produced by oxidation of carbonaceous material to maintain the temperature of the carbonaceous material substantially constant during oxidation to avoid thermal runaway.

2. The method defined in claim 1 wherein the required degree of oxidation in step (c), measured as the weight of oxygen supplied to the packed bed as a percentage of the total weight of the coal in the packed bed, is in the range of 0.2 to 5 wt %.

3. The method defined in claim 2 wherein the target temperature is less than 50° C.

4. The method defined in claim 2 wherein the required degree of oxidation is in the range of 0.5 to 3 wt %.

5. The method defined in claim 4 wherein the target temperature is less than 35° C.

6. The method defined in claim 1 further comprising removing heat from the packed bed in step (d) by means of circulating a working fluid through the packed bed and a coolant circuit which includes heat transfer surfaces in the packed bed.

7. The method defined in claim 6 wherein the working fluid is a gas.

8. The method defined in claim 7 wherein step (b) comprises a first stage of cooling the carbonaceous material from the elevated temperature to a preferred oxidation temperature of the carbonaceous material without supplying oxygen-containing gas to the packed bed during this initial cooling stage.

9. The method defined in claim 8 wherein step (c) comprises supplying the oxygen-containing gas to the packed bed to partially oxidise the carbonaceous material when the carbonaceous material reaches the preferred oxidation temperature.

10. The method defined in claim 9 wherein, after partial oxidation step (c) is completed, step (b) comprises a second stage of cooling the carbonaceous material to the target temperature.

11. The method defined in claim 6 further comprising controlling the temperature of the heat transfer surfaces relative to a preferred oxidation temperature to maintain a small gradient across the bed.

12. The method defined in claim 11 wherein the temperature difference is less than 40° C.

13. The method defined in claim 6 further comprising controlling the temperature of the working fluid to be greater than the wall temperature of the internal heat transfer surfaces and less than that of the carbonaceous material.

14. The method defined in claim 8 wherein the preferred oxidation temperature is in the range of 80–150° C.

15. The method defined in claim 14 wherein the preferred oxidation temperature is in the range of 100–150° C.

16. The method defined in claim 14 wherein the preferred oxidation temperature is in the range of 100–120° C.

17. The method defined in claim 1 further comprising pressurising the packed bed with an externally supplied gas to a pressure of less than 20 bar.

18. The method defined in claim 11 further comprising controlling the temperature of the working fluid to be greater than a wall temperature of the internal heat transfer surfaces and less than that of the carbonaceous material.

19. The method defined in claim 12 further comprising controlling the temperature of the working fluid to be greater than a wall temperature of the internal heat transfer surfaces and less than that of the carbonaceous material.

* * * * *

UNITED STATES PATENT AND TRADEMARK OFFICE

CERTIFICATE OF CORRECTION

PATENT NO. : 6,878,174 B1
DATED : April 12, 2005
INVENTOR(S) : David Stewart Conochie It is certified that error appears in the above-identified patent and that said Letters Patent is hereby corrected as shown below:

Column 6,
Line 49, after "temperature" insert -- of the carbonaceous material --.

Signed and Sealed this

Seventeenth Day of January, 2006

JON W. DUDAS
*Director of the United States Patent and Trademark Office*